United States Patent [19]

Keddie

[11] 4,236,702

[45] Dec. 2, 1980

[54] PICTURE FRAME MAKING TOOL

[76] Inventor: Burton G. Keddie, 1705 Wedgewood West, Elm Grove, Wis. 53122

[21] Appl. No.: 966,845

[22] Filed: Dec. 6, 1978

[51] Int. Cl.[3] ..... B25B 1/20

[52] U.S. Cl. ..... 269/41; 269/295; 269/307

[58] Field of Search ..... 269/41, 42, 307, 87.2, 269/111-112, 295; 83/761-764, 821, 823, 522; 403/353

[56] References Cited

U.S. PATENT DOCUMENTS

| | | | |
|---|---|---|---|
| 985,086 | 2/1911 | Wilkes | 269/124 |
| 1,221,601 | 4/1917 | Rowland | 269/112 |
| 1,632,918 | 6/1927 | Olson | 269/115 |
| 3,392,972 | 7/1968 | Wing | 269/111 |
| 3,590,458 | 7/1971 | Day | 269/112 |
| 4,009,507 | 3/1977 | Lascarron | 403/353 |
| 4,023,787 | 5/1977 | Violette | 269/41 |
| 4,056,030 | 11/1977 | Hahn | 83/522 |

*Primary Examiner*—Robert C. Watson
*Attorney, Agent, or Firm*—Ralph G. Hohenfeldt

[57] ABSTRACT

A picture frame making tool or jig comprises two frame rail clamps interconnected by a scale bar in adjustably spaced relationship. The frame rail clamps have jaws with shoulders adapted to be received in the picture receiving groove of the frame rail, whereby the rail is clamped between its outer edge and at the inside edge of its picture receiving groove. The scale is graduated to read in units of length related to the distance between the corners of the picture receiving groove, whereby the user can saw miter cuts at the ends of the rail, and the cut rail will be of the correct length to receive the picture in its picture receiving groove. The clamps further comprise corner clamps for clamping two miter cut frame rails together in angular relationship for assembly. One of the jaws of each corner clamp is offset inwardly from the centerline of the saw cut by a distance compensating for the saw kerf, thus enabling the mitered ends of both angularly related frame rails to be butted against one another and fastened together without further rail adjustment to accommodate for the kerf. The frame rail clamps are releasably connected to a table by table clamps having pivotal connections therebetween, whereby the frame rail clamps may be swung to nailing position.

9 Claims, 16 Drawing Figures

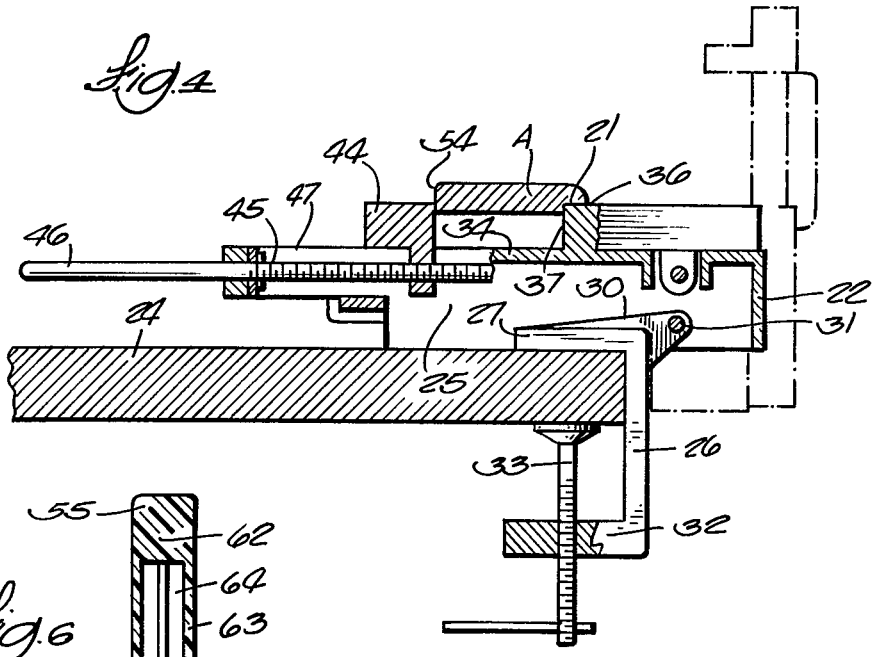
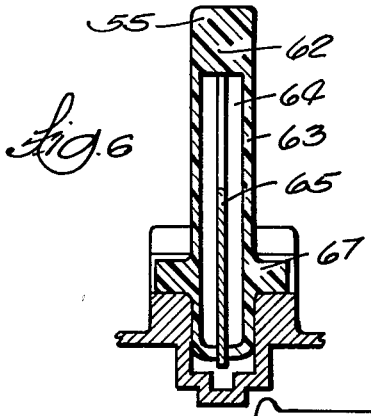
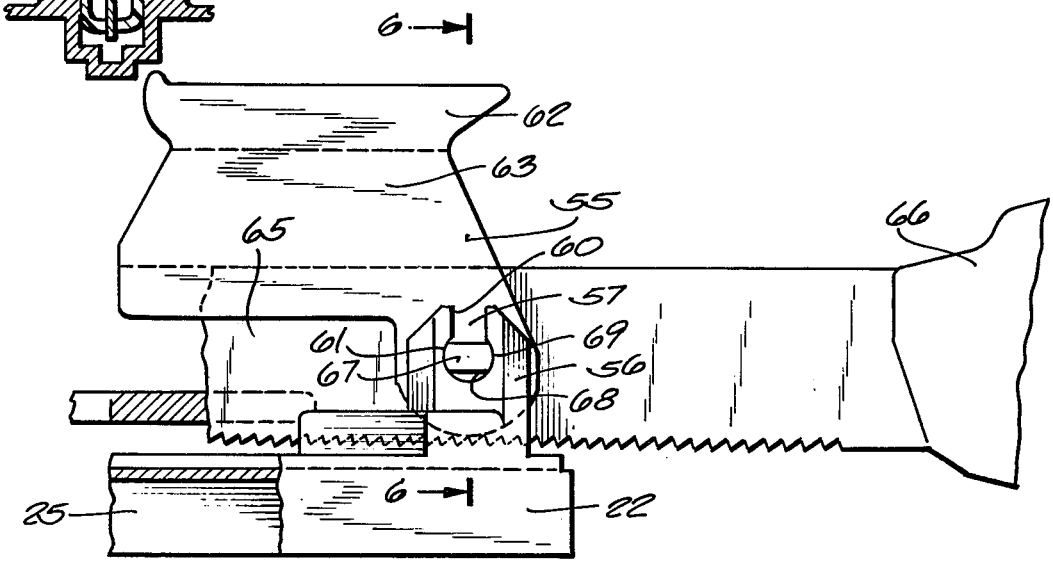
Fig.5

Fig. 4
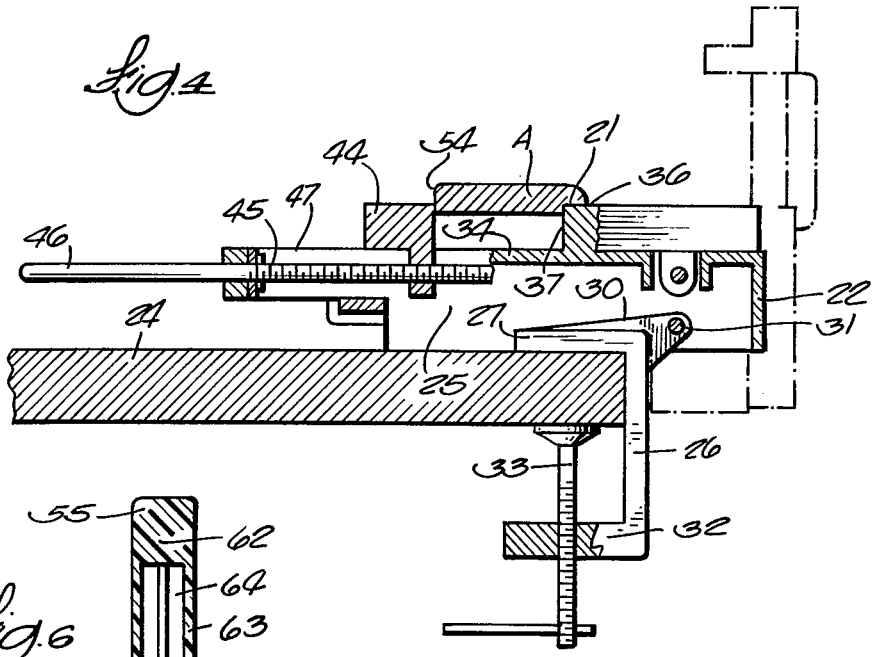
Fig. 6
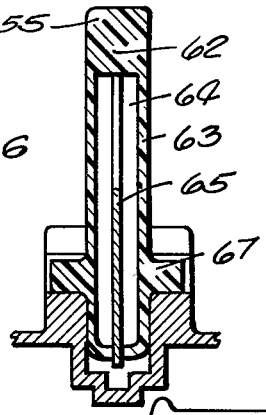
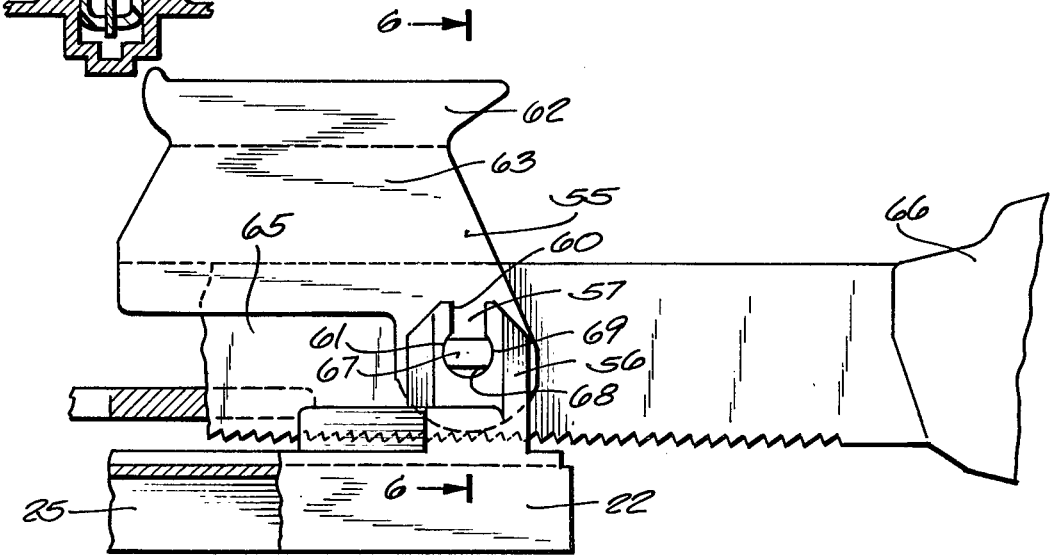
Fig. 5

PICTURE FRAME MAKING TOOL

BACKGROUND OF THE INVENTION

Heretofore, picture frame rails or moldings have typically been cut in a conventional miter box or on a special corner and miter box clamp set. Considerable skill is required to utilize the prior art apparatus because the user must make measurements and perform adjustments to accommodate for the fact that the picture frame rails have a picture receiving groove or rabbet into which the picture fits, and it is essential that the frame rails be interconnected with the picture receiving groove of the proper size to accept the picture. The corners of the picture receiving groove are offset inwardly from the edges of the picture frame rail, and it is a difficult task for an unskilled user to make the proper measurements and miter cuts and perform the necessary assembly operations to produce a correctly sized picture frame.

SUMMARY OF THE INVENTION

In accordance with the present invention, a picture frame making tool or jig is provided in which the structure of the tool is such that measurement and assembly complications have been taken into account and "built" into the tool. All that the user has to do is to know the size of the picture which is to be framed and set the scale of the tool to this dimension and proceed to miter cut and assemble the parts in the tool. All adjustments to accommodate for the inward offset of the picture framing groove, width of the saw kerf, etc., are built into the tool and need be given no thought at all by the user. All such adjustments are automatically made by the tool.

Structurally, the picture frame making tool or jig comprises two frame rail clamps, each having a fixed jaw and a movable jaw. A scale bar interconnects the clamps in spaced apart relationship and means are provided for adjusting the spacing between the clamps. Each of the fixed jaws of the clamps has a shoulder adapted to be received in the picture receiving groove of the frame rail. The rail is clamped between its outside edge engaged with the movable jaw and the inside edge of its picture receiving groove engaged by the shoulder of the fixed jaw. The scale is graduated to read in units of length related to the distance between the corners of the picture receiving groove, thus automatically accommodating for the fact that the outside dimensions of the rail are different from the dimensions of the picture receiving groove.

The frame rail clamps are provided with a saw guide adapted to guide a saw for a miter cut at the ends of a clamped picture frame rail. The saw guide is disposed on the clamp in offset relation to the jaw shoulder a distance equal to approximately one-half of the kerf of the saw. Accordingly, when the saw cut is made, its edge will be formed at the correct location without dislocation caused by the kerf.

Each frame rail clamp further comprises a corner clamp for clamping two miter cut frame rails together in angular relationship. Accordingly, after all four rails of a rectangular or square picture frame have been cut to proper size, they may be assembled and fastened together in the tool. To facilitate assembly, the shoulder of one of the sets of fixed jaws is offset inwardly from the centerline of the saw cut by a distance sufficient to enable the mitered end of the frame rail against that shoulder to contact the mitered end of the frame rail clamped in the other set of jaws without readjusting the jaws of said other frame jaw in its clamp to accommodate for the saw kerf.

The saw guide for each corner clamp comprises a saw guide frame. In preferred embodiments, only one saw guide frame need be provided, as it is removably attached to each corner clamp. The saw guide frame is desirably pivotally mounted on the clamp to facilitate manipulation of the saw. Also in preferred embodiments, the pivotal connection between the saw guide frame and the corner clamp involves a slip connection between the two in which a trunnion on the saw guide frame has a configuration which enables it to be slipped into engagement with its bearing seat and rotated in the seat thereafter.

Both corner clamps desirably have pivoting table clamps by which the corner clamps are releasably secured to a table or workbench. The pivoting arrangement is such that after angularly related frame rails are assembled, the corner clamps can be swung to a vertical position to facilitate nailing the rails together.

Other objccts, features, and advantages of the invention will appear from the disclosure hereof.

DESCRIPTION OF THE DRAWINGS

FIG. 2 is a fragmentary plan view of the tool mounting on a workbench or table.

FIG. 4 is a fragmentary vertical cross section taken along the line 4—4 of FIG. 2.

FIG. 5 is a fragmentary vertical cross section taken along the line 5—5 of FIG. 2.

FIG. 6 is a fragmentary vertical cross section taken along the line 6—6 of FIG. 5.

FIG. 16 is a perspective view of one of the corner clamp units releasably attached by its table clamp to the table.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 10:
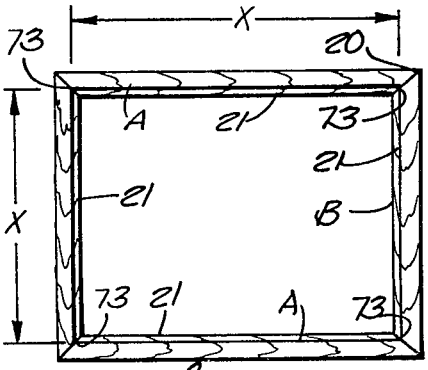
FIG. 10 is a plan view of an assembled picture frame.

FIG. 10 illustrates an assembled picture frame which may be either square or rectangular, but which is illustrated as rectangular in this figure. The frame is typically made of wood moldings, the ends of which are miter cut and secured together by nails and/or adhesive. Top and bottom long frame rails A are of equal length, and shorter side rails B are also of equal length. Rails A and B intersect at a 90° corner angle, the butting ends 20 of the rails having miter cuts at 45°. As is conventional, each frame rail A and B has a picture receiving groove 21 which form a continuous rabbeted recess to receive the picture to be framed. For illustrative purposes, assume a picture to be framed to be 25" long and 15" wide. If desired, the grooves 21 in each frame may be slightly longer than the picture dimension, thus to provide a slight clearance between the edges of the picture and the groove walls when the picture is received therein. This clearance is typically 1/16". Hereinafter in this specification, when a groove length dimension is given, it will be referred to as a nominal dimension, which may be exactly the dimension of the picture, or it may include such clearance.

Figure 1:
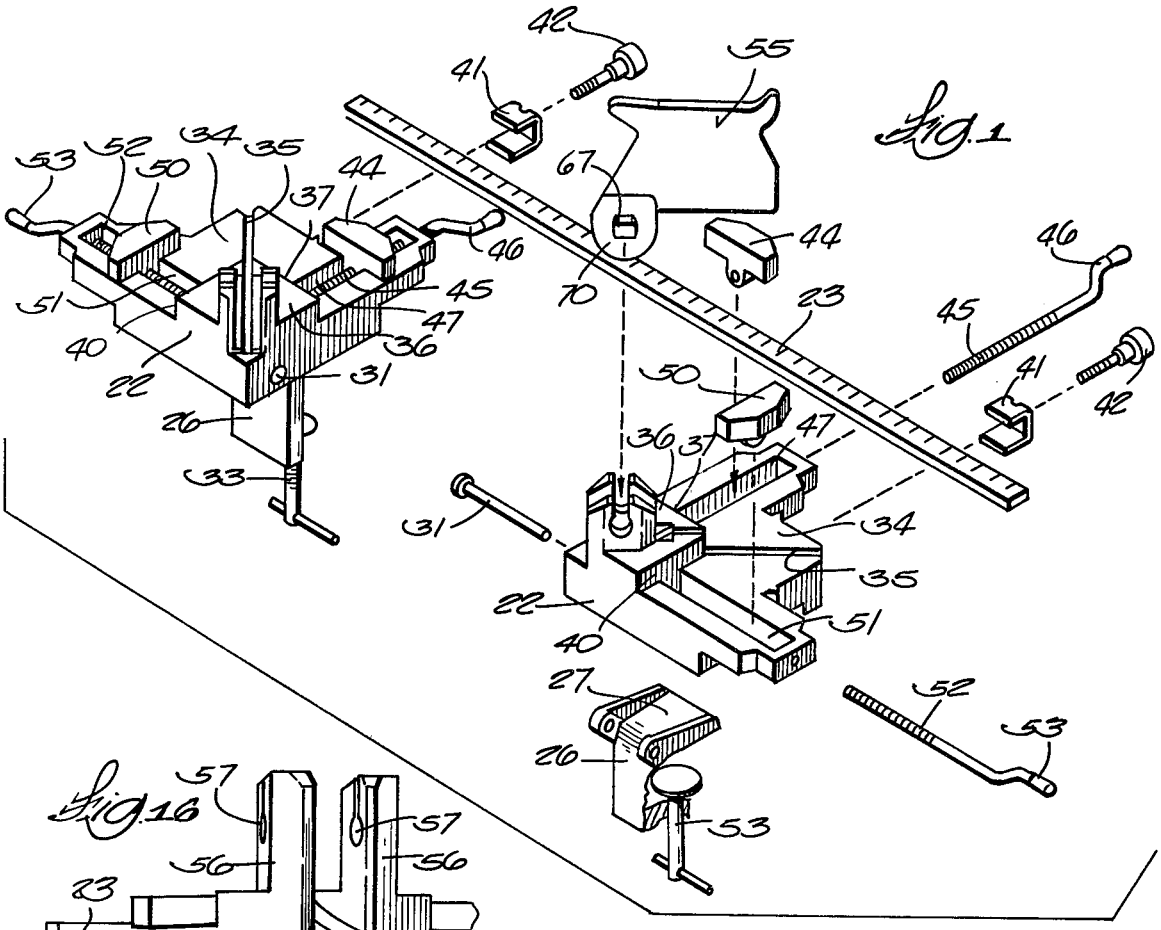
FIG. 1 is a perspective exploded view of a picture frame making tool embodying the invention.
Figure 1A:
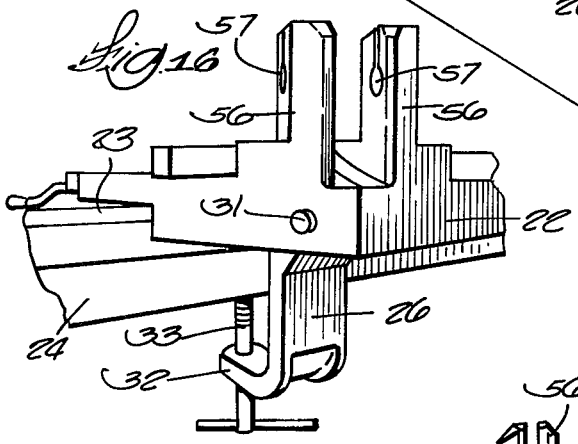

Referring to FIGS. 1 and 2, the picture frame making tool jig of the invention comprises two corner clamp units 22 which are mirror images of one another and are adjustably interconnected by a scale bar 23.

The interconnected corner clamp units 22 and scale bar 23 are handled as a unitary assembly. In use, these are detachably secured to a table or bench top 24. Each clamp unit 22 has a hollow interior 25 (FIG. 4) within which the jaw 27 of a table clamp 26 is received. Table clamp 26 is mounted on a swing bracket 30 from pintle 31 which spans across the interior of the hollow clamp unit 22.

Table clamp 26 has a lower jaw 32 which receives table clamp screw 33 by which the clamp 26 is releasably attached to the table top 24. When thus mounted, pintles 31 of both clamp units 22 are aligned on a common axis. The unitary assembly of the two frame rail clamps 22 and scale bar 23 may be swung about the common axis of pintles 31 from a position in which the clamps 22 are generally horizontal, as shown in full lines in FIG. 4, to a position in which the clamps are generally vertical, as shown in broken lines in FIG. 4 and in full lines in FIG. 15. This facilitates nailing of the mitered corners of the assembled frame rails as hereinafter described.

Figure 3:
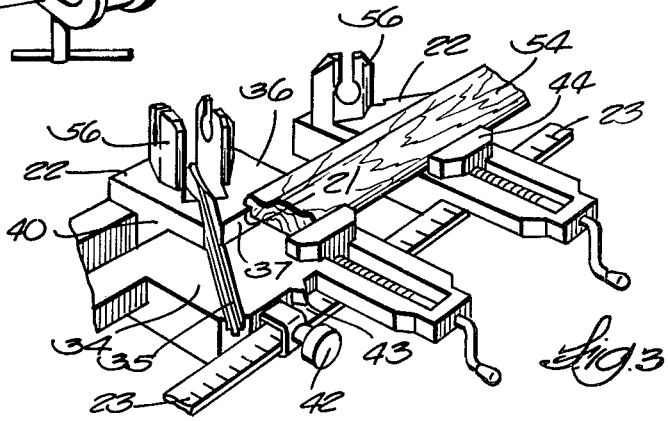
FIG. 3 is a fragmentary perspective view illustrating a fragment of a frame rail clamped in the tool.

As best shown in FIGS. 1, 2, and 3, each frame rail clamp 22 comprises a saw guide platform 34 in which saw guide groove 35 is provided at an angle which bisects the corner on which the frame rails are assembled. Accordingly, saw guide grooves 35 are at a 45° angle to the frame rail A shown in full lines in FIG. 2 and to frame rails B shown in broken lines in FIG. 2.

Clamp 22 further comprises an elevated platform 36 which provides a bed to support the respective frame rails A, B when the frame rails are clamped in the corner clamps 22. Bed 36 is at a higher level than the saw guide platform 34 in order to bed the frame rail on its picture receiving groove 21 as shown in FIGS. 3 and 4. Accordingly, edge 37 of bed 36 constitutes a shoulder engaged in the frame rail groove 21. Shoulder 37 is parallel to the scale bar 23.

Figure 9:
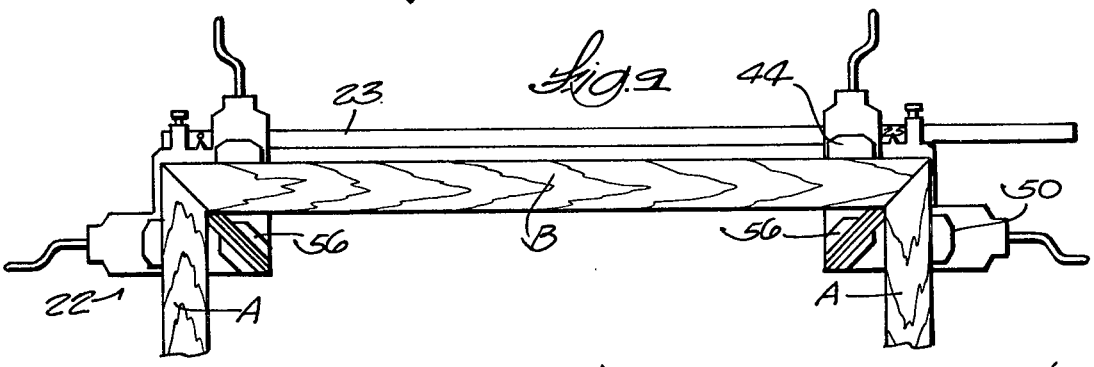
Figure 11:
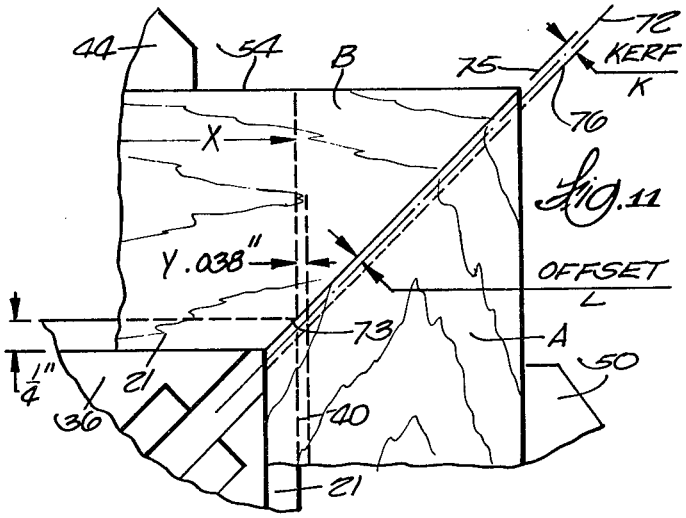
FIG. 11 is a fragmentary plan view of a corner clamp and showing the miter cut and the relationship between the miter cut and the clamp.

The intersecting edge or shoulder 40 of bed 36 which is perpendicular to shoulder 37 seats into picture receiving groove 21 of the other frame rail when the rails are assembled at right angles, as shown in FIGS. 9 and 11, and is indicated in broken lines in FIG. 2.

Scale bar 23 is adjustably secured to the corner clamps 22 by means of the brackets 41 and thumb screws 42. Each corner clamp 22 is provided with an index pointer 43 with respect to which the scale bar 23 is adjustable so that the spacing between the index pointers 43 on the respective corner clamps 22 can be accurately set on the scale 23.

As shown in FIG. 2, the index pointers 43 are aligned with the shoulders 40 of the platforms 36 on which the frame rails are supported. Accordingly, the spacing between the clamps 22 may be set on scale 23 to establish the exact distance between the shoulders 40 on the frame rail receiving beds 36 of the clamps 22.

The reason for the alignment of shoulders 40 with scale pointers 43 is to make all measurements and settings of spacings between the corner clamps 22 directly readable in terms of the nominal length x of the picture receiving grooves 21 of the frame rails A and B, as shown in FIG. 10. The user of this tool will know the nominal distance x because this distance can be measured by a ruler on the picture to be framed. For example, for framing a picture 15"×25", the distance x for frame rail A is nominally 25", and the distance x for frame rail B is nominally 15". Accordingly, when cutting frame rails A, the user will set the pointers 43 on scale 23 at 25" for cutting rails A, and at 15" for cutting rails B, and this will automatically result in the miter cuts on rails A and B to produce rails of the proper length so that the picture receiving grooves 21 will be nominally 15"×25", even though the over-all length of each rail A and B will be some other dimension, depending upon the width of the rail.

As hereinbefore indicated, the tool may be designed to provide a slight additional clearance length for each groove and this clearance is not shown on scale 23. It may be built into the structure of the corner clamps 22. When scale 23 reads 25" between pointers 43, shoulders 40 on the clamps 22 are spaced apart 25 1/16", thus to automatically include the clearance, in tools incorporating this feature.

In each of the corner clamps 22, the shoulders 37, 40 of the raised platform 36 constitutes a fixed jaw of a clamp, the other jaw of which is movable, whereby to clamp a frame rail therebetween. The clamp for the rail which is parallel to scale bar 23 consists of the fixed jaw 37 and a movable jaw 44 actuated by a screw 45 and crank handle 46. Movable jaw 44 is guided in a slot 47 provided in the platform 34 and is otherwise conventional.

The clamp for the frame rail which is perpendicular to the scale bar 23 is made up of the fixed jaw 40 and a movable jaw 50 slidable in the groove 51 in bed 34 under control of the screw 52 as turned by the crank 53.

In order to fabricate the picture frame illustrated in FIG. 10, the user will first measure the picture and determine the length of the top and bottom frame rails A and the side frame rails B. In the example used for illustration, the picture is 25" long and 15" wide, thus requiring nominal dimension x for the picture receiving groove 21 of frame rails A to be 25" and the picture receiving grooves for frame rails B to be 15".

In order to cut frame rail stock to the proper length to serve as frame rail A, the user assembles the two corner clamps 22 with the scale bar 23, as shown in FIG. 2, with the lefthand corner clamp 22 having its pointer 43 at the "0" scale indicia and its righthand corner clamp 22 with its pointer 43 at the "25" indicia on scale 23. As thus assembled, the tool is adapted to cut frame rails A with a picture receiving groove 21 with a nominal length of 25". The tool is then clamped to the table or workbench 24, using the table clamps 26 as shown in FIGS. 4 and 16, and frame rail stock A is clamped in the tool as illustrated in FIGS. 2, 3, 4, and 7, with the picture receiving groove 21 engaged against the shoulder 37 of the bed 36 and movable clamp jaws 44 engaged against the edge 54 of the frame rail A.

Figure 13:
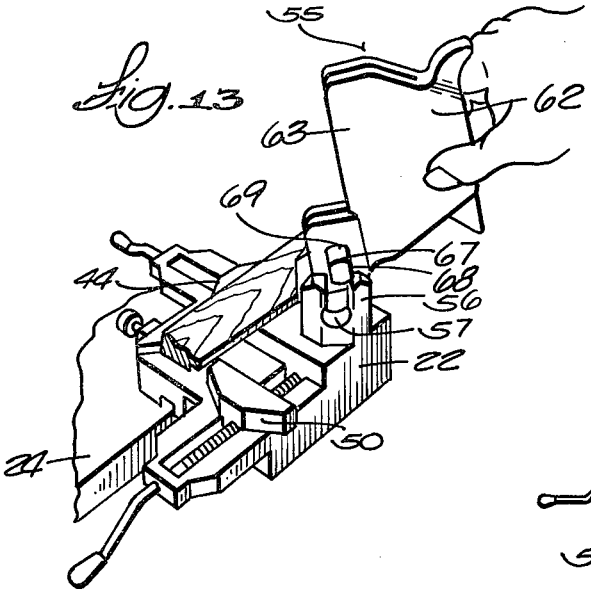
FIG. 13 is a fragmentary perspective view showing the manner of releasably interconnecting the saw guide frame with its saw guide holder.

A saw guide frame 55 is now assembled with the corner clamp 22 as illustrated in FIGS. 5 and 13. For this purpose, each corner clamp 22 is provided with a set of spaced upstanding bracket posts 56 best shown in FIGS. 3, 5, 13, and 16. Each bracket post is provided with a keyhole slot 57 having an entrance portion with flat sides 60 and an arcuate bearing eye or seat portion 61, as shown in FIG. 5.

The saw guide frame 55 comprises a backbone 62 having parallel side plates 63 which are spaced apart to provide a channel 64 within which a saw blade 65 is guided, as shown in FIG. 6. Saw blade 65 has a handle 66 by which it is manipulated. Plates 63 of the saw guide frame 55 are provided with bracket extensions 70 from which trunnions 67 project laterally.

Trunnions 67 have oppositely disposed flat sides 68 and oppositely disposed curved sides 69. The flat sides 68 are narrowly spaced apart so that they will slide through the narrow entrance slot 60 of the keyhole slot 57 when the guide frame 55 is positioned vertically as shown in FIG. 13. However, once fully seated, and the saw guide frame 55 is swung to its horizontal position shown in FIG. 5, the curved sides 69 of trunnions 67 will rotate on the curved or circular eye portion 61 of keyhole slot 57, as shown in FIG. 5, to enable the angle of attack of the saw 65 as guided by the saw guide frame 62 to be adjusted as determined by the user. The pivotal saw guide also facilitates the user's bringing the saw teeth directly against the workpiece, regardless of its thickness, thus to enhance the accuracy of the cut and the capacity of the saw guide to guide the saw.

Figure 7:
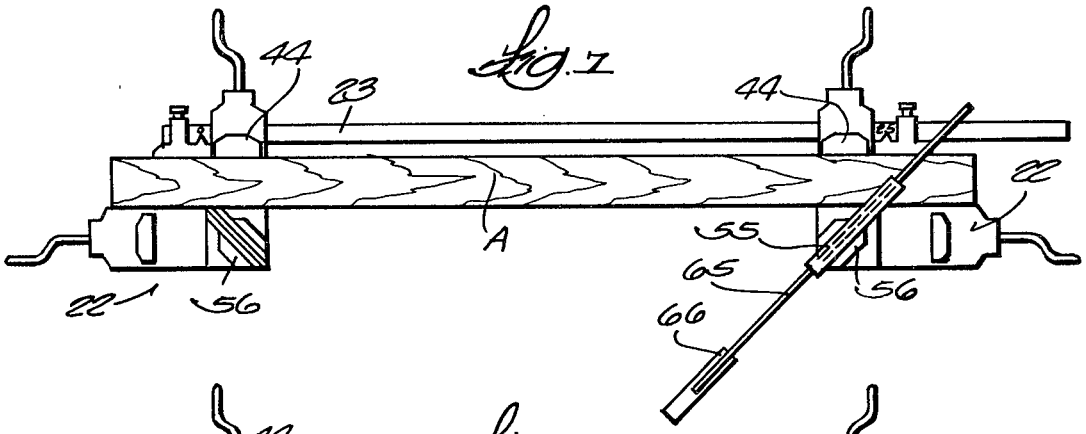
FIGS. 7, 8, and 9 are fragmentary diagrammatic plan views illustrating the various steps in the fabrication of a picture frame.
Figure 8:
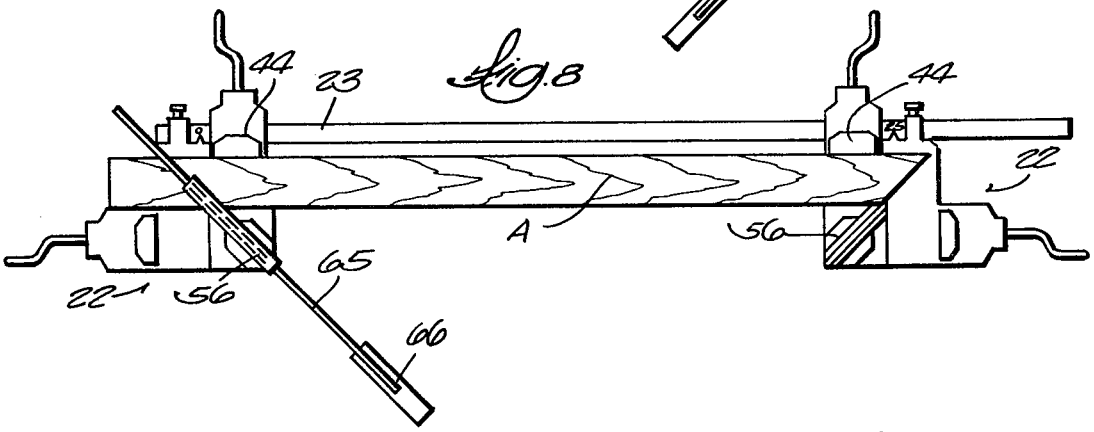

The user will now miter cut each end of the clamped frame rail A, as illustrated successively in FIGS. 7 and 8.

Figure 12:
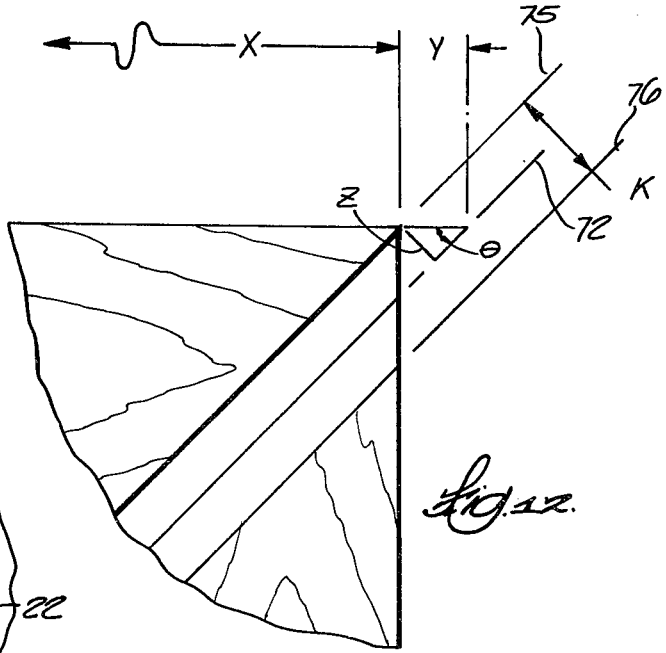
FIG. 12 is an enlarged fragmentary view based on FIG. 11 and illustrating the trigonometric calculation of the offset of the corner clamp shoulder to accommodate for the saw kerf.

In the course of cutting the frame rail as illustrated in FIGS. 7 and 8, the saw 65 will remove some of the material of the rail in the form of sawdust. The tool of the present invention is so constructed as to accommodate for the removal of this sawdust and nevertheless produce a cut rail of exactly the correct length, regardless of the kerf of the saw and the action of the saw in removing sawdust. The accommodation is illustrated in FIGS. 11 and 12. The centerline of the saw cut is indicated by line 72. The kerf of the saw is indicated by lines 75, 76, the width of which is dimension K. Accordingly, the saw guide slot 35 (FIGS. 1, 2, 3) and the bearing posts 56 on which the saw guide frame 55 are mounted are offset from the corner 73 (FIG. 11) of the picture frame receiving groove 21 of mounted frame rails A and B a distance equal to one-half of the kerf K, thus to dispose the saw centerline 71 in a proper position so that the cut line 75 in the rail will register with corner 73. In a typical saw, the kerf is 0.054". Accordingly, the offset indicated by dimension L in FIG. 11 is 0.027". Accordingly, the saw cut is deliberately offset laterally from the corner 73 so that when the saw cuts have been finished, the nominal x dimension of the frame rail will be exactly correct to accept the picture in the grooved recess 21.

Figure 14:
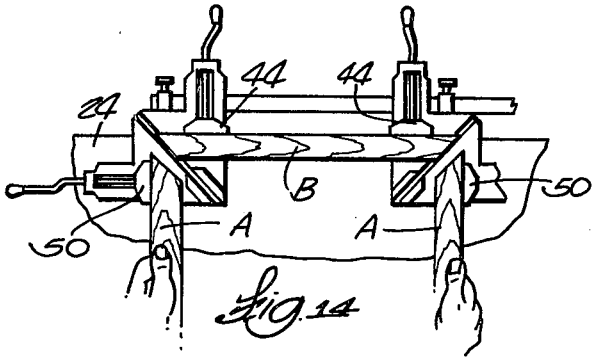
FIG. 14 is a perspective view illustrating the assembly of frame rail sections in the tool.

After both the top and bottom rails A for the picture frame of FIG. 10 have each been cut individually on the tool as shown in FIGS. 7 and 8, the side rails B will be cut in the same manner, except that the scale bar 23 will have to be reset with the pointer 43 of the righthand corner clamp 22 set on nominal scale indicia "15", in order to cut frame rails B exactly to nominal dimension of 15" for their picture receiving grooves 21. After the last frame rail B has been cut, it will be left clamped in the tool, as shown in FIG. 14. The two previously cut frame rails A will then be assembled therewith as shown in FIG. 14.

For this purpose the precut frame rails A will be clamped between the movable jaws 50 and the shoulders 40 of the beds 36 on the corner clamps 22 in order to butt the miter cut ends of the rails, as shown in FIGS. 9 and 11. FIG. 11 also illustrates a significant structural feature of the corner clamp in which shoulder 40 of platform 36 is offset inwardly from the centerline 72 of the saw cut by a distance sufficient to enable the mitered end of frame rail A to contact the mitered end of frame rail B without previously readjusting the position of the frame rail B in its clamp 22. But for this inward offset, it would not be possible to butt the mitered edges of the two rails without previously loosening movable jaw 44 from engagement with the edge 54 of frame rail B and shifting the rail to the right in FIG. 11. However, by offsetting shoulder 40 to the left a distance equal to dimension y in FIG. 11, such readjustment is not necessary. Here, again, this offset y is built into the structure of the tool to accommodate for the kerf K. Distance y is determined trigonometrically and is equal to one-half the kerf K divided by the since of the miter angle which in the case of picture frame rails joined at a 90° angle, is 45°. Offset y is illustrated in enlarged form in FIG. 12 in which the dimension y equals dimension z divided by the sine of the angle theta. Dimension z is equal to one-half the kerf K. For a kerf of 0.054", dimension y equals 0.0382". As the saw is used and loses its set, its kerf will decrease. No provision is made to accommodate for such saws. For best results, the saw should be properly set.

Both of the clamps 22 have the offset relationship illustrated in FIG. 11. Accordingly, when the precut rails A and B are assembled as shown in FIG. 9, all errors which might otherwise occur for failure to account for the kerf of the saw are automatically taken into account and corrected in the tool of the present invention.

Figure 15:
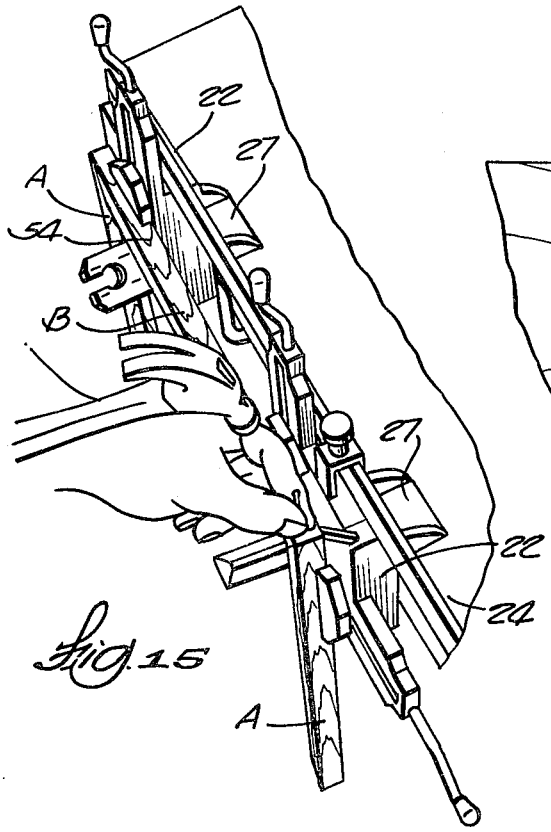
FIG. 15 is a perspective view illustrating the swinging of the frame making tool to a vertical nailing position.

To facilitate nailing the clamped rails of FIG. 9 together, the tool or jig is now desirably pivoted about the common axis of pintles 31 to its vertical position shown in FIG. 15 in which the edge 54 of rail B is horizontal. In this way the operator can nail into the edge 54 and endwise into the mitered end of the rails A, as shown in FIG. 15. If desired, glue can be applied to the butting ends of the rails A, B prior to the assembly thereof as shown in FIG. 9.

After nailing as in FIG. 15, an assembled partially finished U-shaped frame results to which it is only necessary to add the last side rail B. For this purpose, the U-shaped frame is removed from the tool, the last remaining side frame B is reclamped in its position shown in FIG. 14, and the free ends of the rails A of the U-shaped frame are clamped into the jig as shown in FIGS. 14 and 9. Glue may be applied to the joints between the positions of FIGS. 14 and 9. The jig is again swung to its FIG. 15 position for nailing. The completed frame is now removed from the tool and is in readiness for any further finishing required and receipt of the picture in the frame grooves 21.

I claim:

1. A picture frame making tool comprising two frame rail clamps, each having a fixed jaw and a movable jaw, a scale bar on which said clamps are mounted for at least one to be moved relative to the other to establish them in a spaced apart relation determinable by reference to measurement indicia on the scale bar, means for locking the clamps against movement relative to said scale bar, each of said fixed jaws having a shoulder adapted to be received in the picture receiving groove of a frame rail whereby the rail is clamped at its outside edge by the movable jaw and at the inside edge of its picture receiving groove by the fixed jaw, said scale bar being calibrated to read in units of length related to the distance between the corners of the picture receiving groove, each frame rail clamp further comprising a saw guide adapted to guide a saw for a miter cut at the ends of a clamped picture frame rail, said saw guide being disposed on said clamp in offset relation to said shoulder a distance equal to approximately one-half the kerf of the saw.

2. The tool of claim 1 in which each frame rail clamp further comprises a corner clamp for clamping two miter cut frame rails together in angular relation, each said clamp having another fixed jaw and another movable jaw for clamping another frame rail, said other fixed jaw having a shoulder adapted to be received in the picture receiving groove of said other frame rail whereby said other rail is clamped between its outside edge by the movable jaw and at the inside edge of its picture receiving groove by the other fixed jaw, the shoulder of the said other fixed jaw being offset inwardly from the centerline of the saw cut by a distance sufficient to enable the mitered end of the other frame rail to contact the mitered end of the first-mentioned frame rail without readjusting the position of the first-mentioned frame rail in its clamp.

3. The tool of claim 2 in which said offset is equal to one-half the kerf divided by the sine of the miter angle.

4. The tool of claim 1 in which said saw guide comprises a saw guide frame and means for removably mounting said frame along said miter cut.

5. The tool of claim 1 in which said saw guide comprises a saw receiving slot bisecting the corner formed by the shoulders on said fixed jaws.

6. A picture frame making tool comprising two frame rail clamps, each having a fixed jaw and a movable jaw, a scale bar interconnecting the clamps in spaced apart relation, means for adjusting the spacing between the clamps, said scale bar being calibrated to read in units of length related to the distance between the corners of the picture receiving groove, a saw guide frame and means for removably mounting said frame on a clamp, said means comprising a pivot on which said frame is pivotally movable relative to the clamp.

7. The tool of claim 6 in which said pivot means comprises spaced brackets having aligned pivot bearing seats and entry slots, said saw guide frame having a trunnion with flat sides receivable through said entry slots and curved sides rotatable in said pivot bearing seats.

8. A picture frame making tool comprising two frame rail clamps, each having a fixed jaw and a movable jaw, a scale bar interconnecting the clamps in spaced apart relation, means for adjusting the spacing between the clamps, said scale bar being calibrated to read in units of length related to the distance between the corners of the picture receiving groove, each frame rail clamp further comprising a corner clamp for clamping two miter cut frame rails together in angular relation, each said clamp having another fixed jaw and another movable jaw for clamping another frame rail, table clamps for releasably attaching said frame rail clamps to a table and means pivotally connecting the table clamps and the frame rail clamps on a common axis for swinging the frame rail clamps to a fastening position.

9. A picture frame making tool comprising two frame rail clamps each having a fixed jaw and a cooperating movable jaw for holding a picture frame rail, bar means on which said frame rail clamps are mounted for one to be moved relative to the other to establish them in spaced apart relationship, means for locking said clamps against movement on said bar means, a saw guide holder mounted to one of said clamps, and saw guide frame removably and pivotally mounted on said holder, said saw guide frame having a laterally extending trunnion having opposed flat sides and opposed curved sides, said holder having a pivot bearing seat with curved sides on which the curved side of the trunnion turns and an entry slot having flat sides on which the flat sides of the trunnion slide, another saw guide holder on the other of said clamps similar to the holder on said one clamp, said saw guide frame with its two trunnions extending laterally from opposite sides thereof being receivable alternately in said other holder with the laterally extending trunnions of said frame engageable in said other holder entry slots and pivot bearing seats.

* * * * *